US012303043B2

(12) United States Patent
Nagel

(10) Patent No.: US 12,303,043 B2
(45) **Date of Patent: *May 20, 2025**

(54) PUSHER TRAY WITH FRONT STOP HAVING PRODUCT SUPPORT PROJECTION

(71) Applicant: Fasteners for Retail, Inc., Twinsburg, OH (US)

(72) Inventor: Thomas O. Nagel, Rockford, IL (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/647,323

(22) Filed: Apr. 26, 2024

(65) Prior Publication Data

US 2024/0292964 A1 Sep. 5, 2024

Related U.S. Application Data

(63) Continuation of application No. 18/171,536, filed on Feb. 20, 2023, now Pat. No. 11,998,124, which is a continuation of application No. 17/386,763, filed on Jul. 28, 2021, now Pat. No. 11,602,229.

(60) Provisional application No. 63/060,492, filed on Aug. 3, 2020.

(51) Int. Cl.

| | |
|---|---|
| ***A47F 1/12*** | (2006.01) |
| ***A47B 45/00*** | (2006.01) |
| ***A47F 5/08*** | (2006.01) |
| ***A47F 5/10*** | (2006.01) |

(52) U.S. Cl.

CPC ..... *A47F 1/126* (2013.01); *A47B 45/00* (2013.01); *A47F 5/08* (2013.01); *A47F 5/10* (2013.01)

(58) Field of Classification Search

CPC .... A47F 1/126; A47F 5/08; A47F 5/10; A47F 5/0081; A47F 5/0018; A47F 7/28; A47F 1/125; A47F 5/0031; A47F 5/0056; A47F 5/0068; A47F 5/0876; A47F 5/13; A47F 1/04; A47B 45/00; A47B 96/025; A47B 96/027

USPC ..... 211/119.003, 175, 59.2, 59.3

See application file for complete search history.

(56) References Cited

U.S. PATENT DOCUMENTS

| | | | |
|---|---|---|---|
| 5,665,304 | A | 9/1997 | Heinen et al. |
| 5,683,003 | A | 11/1997 | Gebka |
| 5,855,283 | A | 1/1999 | Johnson |
| 6,142,317 | A | 11/2000 | Merl |
| 7,918,353 | B1 | 4/2011 | Luberto |
| 8,210,367 | B2 | 7/2012 | Nagel et al. |
| 8,302,784 | B2 | 11/2012 | Nagel et al. |
| 8,567,618 | B2 | 10/2013 | Tan |
| 8,720,702 | B2 | 5/2014 | Nagel |
| 9,129,494 | B2 | 9/2015 | Valiulis et al. |
| 9,138,076 | B2 | 9/2015 | Hardy |

(Continued)

FOREIGN PATENT DOCUMENTS

| | | | |
|---|---|---|---|
| EP | 3970568 | A1 | 3/2022 |
| WO | WO 2014/093610 | A1 | 6/2014 |
| WO | WO 2014/159241 | A1 | 10/2014 |

*Primary Examiner* — Jennifer E. Novosad

(74) *Attorney, Agent, or Firm* — Reinhart Boerner Van Deuren P.C.

(57) ABSTRACT

The merchandise tray includes a front stop having a product support surface. The product support surface is located between mounting features that attach the front stop to the rest of the retail merchandise tray. The front stop itself is an embodiment as well.

11 Claims, 13 Drawing Sheets

(56) References Cited

U.S. PATENT DOCUMENTS

| | | | | |
|---|---|---|---|---|
| 9,241,583 | B2 | 1/2016 | Nagel | |
| 9,254,049 | B2 | 2/2016 | Nagel | |
| 9,392,883 | B2 | 7/2016 | Kologe | |
| 9,629,480 | B2 | 4/2017 | Ewing et al. | |
| 9,986,852 | B2 | 6/2018 | Chenoweth et al. | |
| 10,034,557 | B1 | 7/2018 | Nagel | |
| 10,251,494 | B1 | 4/2019 | Nagel | |
| 10,786,094 | B2 | 9/2020 | Bruegmann | |
| 11,166,571 | B2 | 11/2021 | Nagel et al. | |
| 11,350,768 | B2 | 6/2022 | Nagel | |
| 11,602,229 | B2 | 3/2023 | Nagel | |
| 11,998,124 | B2 * | 6/2024 | Nagel | A47F 1/126 |
| 2004/0011751 | A1 | 1/2004 | Johnson et al. | |
| 2006/0273053 | A1 | 12/2006 | Roslof et al. | |
| 2007/0170127 | A1 | 7/2007 | Johnson | |
| 2008/0156752 | A1 | 7/2008 | Bryson et al. | |
| 2010/0176075 | A1 | 7/2010 | Nagel et al. | |
| 2010/0176077 | A1 | 7/2010 | Nagel et al. | |
| 2011/0017684 | A1 | 1/2011 | Nagel et al. | |
| 2012/0048817 | A1 | 3/2012 | Green et al. | |
| 2014/0167962 | A1 | 6/2014 | Valiulis et al. | |
| 2015/0068991 | A1 | 3/2015 | Kostka | |
| 2015/0083677 | A1 | 3/2015 | Tan | |
| 2015/0164241 | A1 | 6/2015 | Nagel | |
| 2015/0196138 | A1 | 7/2015 | Juric | |
| 2020/0093282 | A1 | 3/2020 | Bruegmann | |
| 2020/0253393 | A1 | 8/2020 | Wills et al. | |
| 2022/0031090 | A1 | 2/2022 | Nagel | |
| 2023/0200563 | A1 | 6/2023 | Nagel | |
| 2024/0292964 | A1 * | 9/2024 | Nagel | A47F 1/126 |

* cited by examiner

PUSHER TRAY WITH FRONT STOP HAVING PRODUCT SUPPORT PROJECTION

CROSS-REFERENCE TO RELATED PATENT APPLICATIONS

This Patent Application is a Continuation of U.S. patent application Ser. No. 18/171,536, filed Feb. 20, 2023, which is currently pending, which is a Continuation of U.S. patent application Ser. No. 17/386,763, filed Jul. 28, 2021, which issued as U.S. Pat. No. 11,602,229 on Mar. 14, 2023. This Patent Application claims the benefit of U.S. Provisional Patent Application No. 63/060,492, filed Aug. 3, 2020, the entire teachings and disclosure each of which are incorporated herein by reference thereto.

FIELD OF THE INVENTION

This invention generally relates to self-facing retail merchandise displays and particularly front stops therefore.

BACKGROUND OF THE INVENTION

Self-facing retail merchandise displays are generally known in the art. One such display is the pusher system. A conventional pusher system incorporates one or more pusher paddles or pusher bodies that ride along a respective elongated track. A spring is connected between the pusher body and a leading edge of the track. The spring acts to bias the pusher body forward along the track towards the leading edge thereof.

A user can retract the pusher body away from the leading edge of the track and position items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

That is, when a customer removes the leading most item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front facing eliminates the necessity for retail store employees to manually face the merchandise, and thus ultimately reduces the cost of labor of the retailer.

The aforementioned pusher systems have been utilized in various retail display environments. One example is a retail shelf. Typically, a plurality of pusher bodies and their corresponding tracks are arranged in a side by side manner along the shelf. Each pusher body and its corresponding track are separated by dividers to maintain a plurality of generally straight rows of merchandise that run from the front to the back of the shelf. Such a familiar configuration can be found in many retail stores for selling hygiene items such as deodorant, as one example.

In another configuration, the pusher system may be embodied as a stand-alone pusher tray. These trays may include means for mounting the tray as a cantilevered extension from another structure, such as a bar. These trays may also be situated directly on a retail shelf. Further, these trays may include side barriers (also referred to as dividers) which are adjustable so as to accommodate merchandise of differing widths. Examples of these trays may be readily seen at U.S. Pat. Nos. 9,254,049; 9,241,583; 8,720,702; 10,034,557; 10,251,494 as well as U.S. Pat. Appl. No. 62/964,476 filed Jan. 9, 2020, each of which is incorporated by reference herein in its entirety.

To prevent the merchandise from simply being pushed off of the tray, the trays include a front stop against which the front most item of merchandise is biased by the pusher. In some implementations, these fronts tops are removable from the remainder of the tray. The tray includes mounts in the form of pins (also referred to as posts) that extend upward that are received in mounting receivers of the front stop.

These mounting receivers project rearward from the rest of the front stop. For some merchandise that is wider than the spacing of the mounting receivers, the merchandise will push against the rear most portion of these mounting receivers, which is often a curved surface. Thus, two line contacts are formed between the front of the merchandise and the rear most extent of the mounting receivers.

Due to this minimal amount of contact area between the mounting receivers and the front of the merchandise coupled with the force of the biasing spring/pusher, the front of the merchandise (e.g. the packaging and/or the product therein) can become dented. This denting can affect the visual appearance of the product. Often, the dented merchandise is simply discarded. This problem is particularly present in product such as candy and more particularly high end chocolate that can be soft at slightly elevated temperatures exacerbating the denting and deformation of the product.

The invention relates to improvements in the above described pusher systems, more particularly, the above described pusher trays. These and other advantages of the invention, as well as additional inventive features, will be apparent from the description of the invention provided herein.

BRIEF SUMMARY OF THE INVENTION

Examples provide new and improved retail merchandise trays and more particularly new and improved retail merchandise trays that avoid altering or damaging the aesthetic appearance of the products displayed therein.

In one example, a retail merchandise tray including a product support structure, a pusher, first and second mounting pins and a front stop is provided. The product support structure extends between a front end and a rear end. The product support structure provides a first product support surface for supporting merchandise thereon. The pusher operably mounts to the product support structure. The pusher is movable along the product support structure above the first product support surface toward and away from the front end along a first axis. The pusher is biased towards the front end. The first and second mounting pins attach to the product support structure proximate the front end. These pins may be part of the product support structure. The first and second mounting pins have an upright position in which the first and second mounting pins extend upward above the first product support surface. The front stop has a front panel section extending upward above the first product support surface. The front panel section has a front side and a rear side. The front stop has first and second mounting pin receivers that are laterally spaced apart from one another along a second axis that is perpendicular to the first axis. The first mounting pin receiver receives the first mounting pin therein and the second mounting pin receiver receives the second mounting pin therein. The front stop has a product support section positioned between the first and second mounting pin receivers. The product support section defines a second product support surface that faces the rear end of the product support structure and the pusher when in the upright orientation. The first and second mounting pin receivers project from the rear side of the front panel section towards the rear end substantially no closer to the rear end than the second product support surface.

In one example, the second product support surface is rearward of the rear side of the front panel section.

In one example, the product support section forms a recess in a front of the front stop, the front panel section extends around the recess.

In one example, a thickness of the front panel section generally parallel to the first axis is equal to a thickness of the portion of the product support section that defines the second product support surface generally parallel to the first axis.

In one example, the front stop includes an offset wall that extends between the front panel section and the product support section, the offset wall bounds the recess.

In one example, a surface area of the second product support surface is at least three, five or 10 (3, 5 or 10) times greater than a surface area of the first and second mounting pin receivers.

In one example, the front stop is a single, continuous piece of molded plastic.

In one example, the first mounting pin receiver is formed from at least one first sidewall that defines a first mounting slot that receives the first mounting pin (this may be curved around the mounting slot. The at least one first sidewall has a first sidewall thickness. The second mounting pin receiver is formed from at least one second sidewall that defines a second mounting slot that receives the second mounting pin (this may be curved around the mounting slot). The at least one second sidewall has a second sidewall thickness. The front panel section has a front panel section thickness. The product support section has a product support section thickness. A variation between the first sidewall thickness, second sidewall thickness, the front panel section thickness and the product support section thickness is no greater than 25%.

In one example, the first and second mounting pins are pivotable between the upright position and a reclined position.

In one example, a first channel is formed between the product support section and the first mounting pin receiver. A second channel is formed between the product support section and the second mounting pin receiver.

In one example, a height of the product support section is at least twenty five percent (25%) greater than a height of the first and second mounting pin receivers.

In one example, signage is located within the recess.

In one example, the first and second mounting pin receivers are spaced apart along the second axis a first distance. The second product support surface has a width measured along the second axis, the width is at least 50% of the first distance, more preferably at least 75% of the first distance.

In one example, the second product support extends entirely between the first and second mounting pin receivers.

In one example, each of the first and second channels has a width measured along the second axis of less than ¼ inch and preferably less than ⅛ inch.

In one example, the front panel section defines an outer periphery that bounds a first area and the product support section has an outer periphery rearward of the front panel section that bounds a second area. The second area is at least 50% the first area.

In one example, the mounting pin receivers project forward of the panel section.

In one example, the second product support surface extends an entire width of the panel section.

In one example, a recess is formed in the rear side of the front stop between the mounting pin receivers and below the second product support surface.

In one example, the panel section extends outward along the second axis beyond the first and second mounting pin receivers.

In one example, a first projection extends from the first mounting pin receiver along the second axis and is spaced apart along the first axis from the portion of the panel section that extends outward beyond the first mounting pin receiver along the second axis forming a gap therebetween. A second projection, opposite the first projection, extends from the second mounting pin receiver along the second axis and is spaced apart along the first axis from the portion of the panel section that extends outward beyond the second mounting pin receiver along the second axis forming a gap therebetween.

In one example, a top end of the first and second projections align with a bottom end of the portions of the panel section that extend outward beyond the first and second mounting pin receivers.

In one example, a cavity/recess is formed between the first and second mounting pin receivers and forward of the panel section.

In another example, a front stop for a retail merchandise tray having first and second mounting pins is provided. The front stop includes a front panel section, a product support section and first and second mounting pin receivers. The front panel section has a front side and a rear side. The first and second mounting pin receivers are spaced apart from one another along a first axis. The first mounting pin receiver receives the first mounting pin therein and the second mounting pin receiver receives the second mounting pin therein when mounted. The product support section is positioned between the first and second mounting pin receivers. The product support section defines a product support surface. The first and second mounting pin receivers project from the rear side of the front panel section no further than the product support surface.

In one example, the product support surface is rearward of the rear side of the front panel section.

In one example, a recess is formed in a front of the front stop. The front panel section extends around the recess.

In one example, a thickness of the front panel section is equal to a thickness of the product support section.

In one example, the front stop includes an offset wall that extends between the front panel section and the product support section. The offset wall bounds the recess.

In one example, a surface area of the second product support surface is at least three, five or 10 (3, 5 or 10) times greater than a surface area of the first and second mounting pin receivers.

In one example, the front stop is a single, continuous piece of molded plastic.

In one example, the first mounting pin receiver is formed from at least one first sidewall that defines a first mounting slot that receives the first mounting pin. The at least one first sidewall has a first sidewall thickness. The second mounting pin receiver is formed from at least one second sidewall that defines a second mounting slot that receives the second mounting pin. The at least one second sidewall has a second sidewall thickness. The front panel section has a front panel section thickness. The product support section has a product support section thickness. A variation between the first sidewall thickness, second sidewall thickness, the front panel section thickness and the product support section thickness is no greater than 25%.

In one example, a first channel is formed between the product support section and the first mounting pin receiver and a second channel is formed between the product support section and the second mounting pin receiver.

In one example, signage is located within the recess.

In one example, the first and second mounting pin receivers are spaced apart along the first axis a first distance. The second product support surface has a width measured along the first axis. The width is at least 50% of the first distance, more preferably at least 75% of the first distance.

In one example, the second product support extends entirely between the first and second mounting pin receivers.

In one example, each of the first and second channels has a width measured along the second axis of less than ¼ inch and preferably less than ⅛ inch.

In one example, the front panel section defines an outer periphery that bounds a first area and the product support section has an outer periphery rearward of the front panel section that bounds a second area. The second area being at least 50% the first area.

In one example, the mounting pin receivers project forward of the panel section.

In one example, the product support surface, extends an entire width of the panel section.

In one example, a recess is formed in the rear side of the front stop between the mounting pin receivers and below the product support surface.

In one example, the panel section extends outward along the second axis beyond the first and second mounting pin receivers.

In one example, a first projection extends from the first mounting pin receiver along the second axis and is spaced apart along the first axis from the portion of the panel section that extends outward beyond the first mounting pin receiver along the second axis forming a gap therebetween. A second projection, opposite the first projection, extends from the second mounting pin receiver along the second axis and is spaced apart along the first axis from the portion of the panel section that extends outward beyond the second mounting pin receiver along the second axis forming a gap therebetween.

In one example, a top end of the first and second projections align with a bottom end of the portions of the panel section that extend outward beyond the first and second mounting pin receivers.

In one example, a cavity/recess is formed between the first and second mounting pin receivers and forward of the panel section.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now the drawings, FIGS. 1-5 illustrate an embodiment of a retail merchandise tray 100 for displaying retail merchandise. The retail merchandise tray can take many forms such as those illustrated in U.S. Pat. No. 10,034,557 or 10,251,494 and/or U.S. Pat. Appl. No. 62/964,476 filed Jan. 9, 2020. The retail merchandise tray 100 is configured to reduce or completely eliminate the denting problem associated with prior retail merchandise trays.

Figure 1:
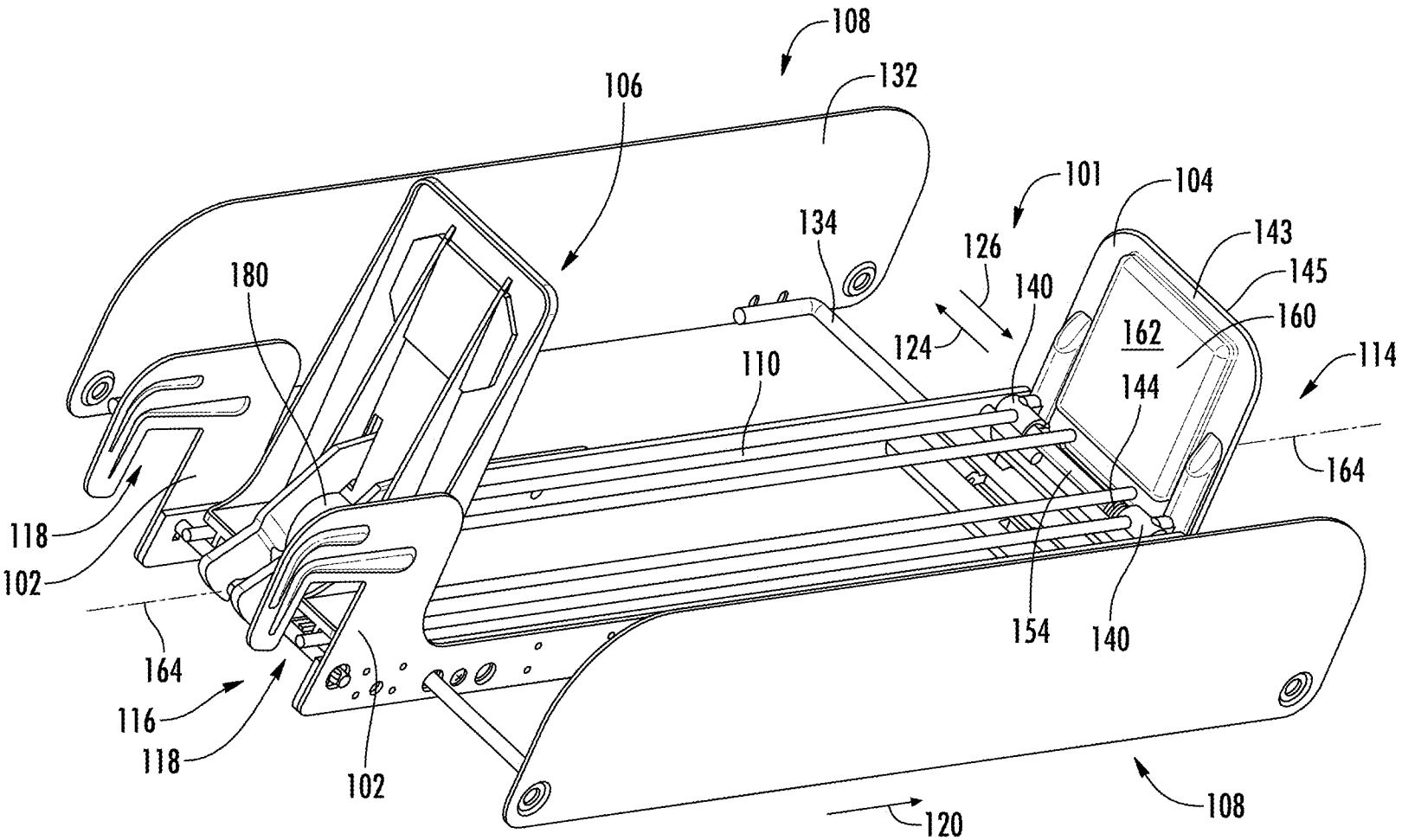
FIG. 1 is a perspective illustration of a retail merchandise tray according to an example.

Turning first to FIG. 1, the same illustrates a tray 100 a product support structure (also referred to as a merchandise support frame) 101 that provides a product support surface that vertically supports retail merchandise thereon. In this example, the product support structure 101 has a pair of load bearing members 102. Load bearing members 102 are identical so a description of one applies equally well to the other. A front stop 104 is connected to the load bearing members at a first end 114 of tray 100. Front stop 104 may include additional integrated or attached structures such as price channel extrusions, faceplates, etc.

The product support structure 101 includes, in this embodiment, a wire support frame 110 that is removably to the load bearing members adjacent a second end 116 of tray 100. This wire support frame 110 is also removably attached to front stop 104 adjacent first end 114. Put differently, wire support frame 110 has opposed first and second ends which are adjacent first and second ends 114, 116 of tray 100, respectively.

The first end of wire support frame 110 is removably attached to front stop 104, while the second end is removably attached to load bearing members 102. As used herein, "removably attached" means an attachment which may be readily undone in a non-destructive manner and subsequently repeated in the same manner. Within this meaning "removably attached" does not include welds, comolding, or other permanent forms of attachment which require component destruction or damage to undo.

While the product support structure 101 is illustrated as including the pair of load bearing members 102 and wire support frame 110, other product support structures such as one-piece metal structures, one-piece plastic structures as well as other combinations of metal and plastic structures are contemplated. The product support structure 101 need only be configured to support the merchandise and allow for self facing thereof.

A pusher 106 is mounted to the product support structure 101 and is movable in directions 120, 122. Pusher 106 is operable to bias a row or rows of retail merchandise situated on top of the product support surface of the product support structure from second end 116 of tray 100 toward first end 114 of tray 100. Pusher 106 is biased under the force of a coil spring 180 or other biasing element.

A pair of movable divider assemblies 108 are positioned on either side of tray 100. Divider assemblies 108 are movable in directions 124, 126 to modify a width or distance between the divider assemblies 108. This lateral adjustment allows for the accommodating retail merchandise of differing widths. Divider assemblies 108 employ a removable attachment between their divider walls and wire supports as well as between the divider assemblies 108 and the rest of the product support structure 101.

As may also be seen in FIG. 1, each load bearing member 102 includes a cut-out 118 sized to receive a retail merchandise bar of the type typically found in refrigerated cases or other retail merchandise displays. This allows for a cantilevered mounting of tray 100.

The two divider assemblies 108 shown are identical. As such, a description of one applies equally well to the other. It should also be noted that although two dividers assemblies 108 are shown, only a single divider assembly 108 may be employed in some alternate configurations, while in other alternate configurations, the divider assemblies 108 may be entirely omitted.

Divider assembly 108 includes a divider wall 132 and a pair of wire supports 134 which are removably attached to divider wall 132.

In some embodiments, the pusher 106 may be mounted to the divider assembly 108 (not shown in this embodiment).

Figure 4:
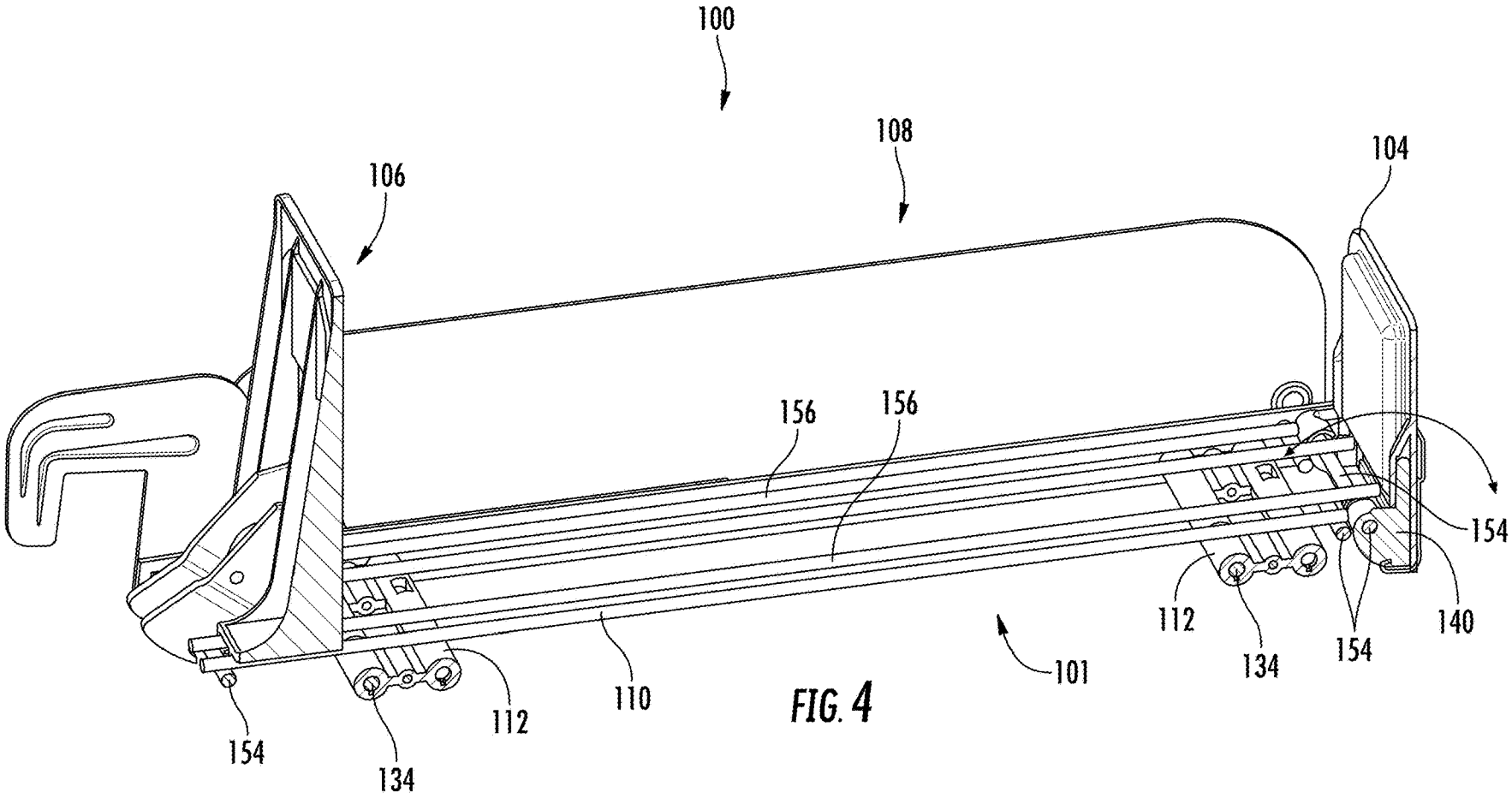
FIG. 4 is a perspective, cross-sectional illustration of the tray of FIG. 1.
Figure 5:
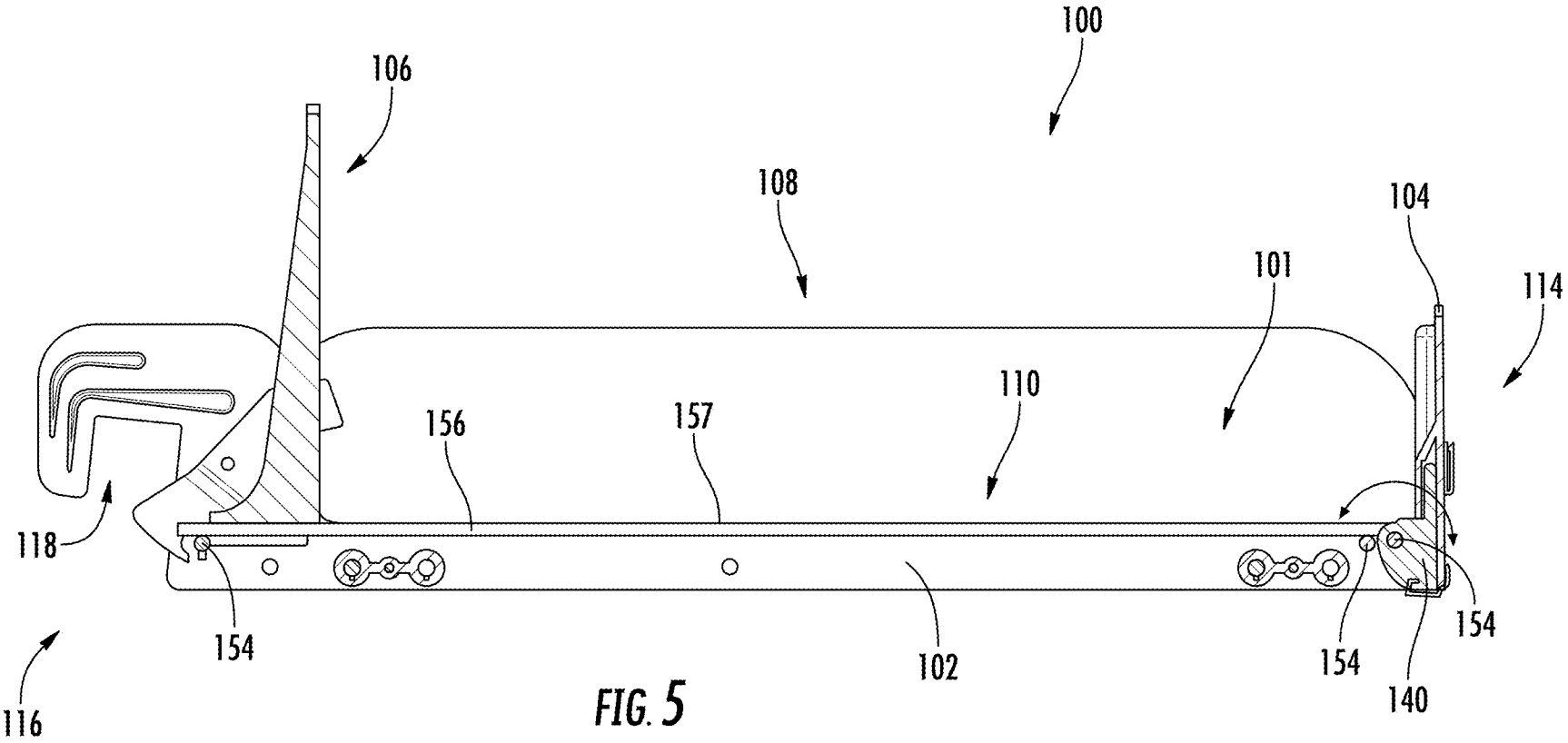
FIG. 5 is a cross-sectional illustration of the tray of FIG. 1.
Figure 6:
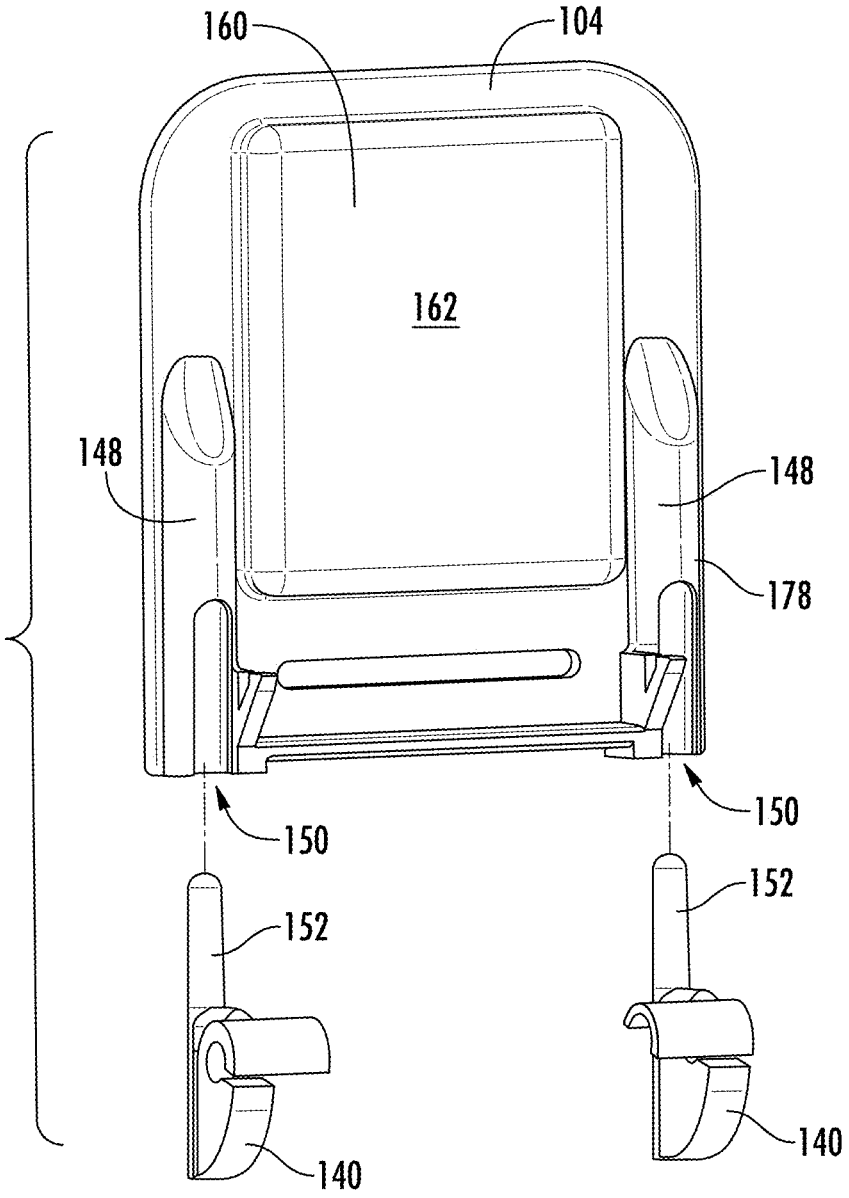
FIG. 6 is an exploded illustration of a front stop and the front stop mounting arrangement used to mount the front stop to the rest of the tray.
Figure 7:
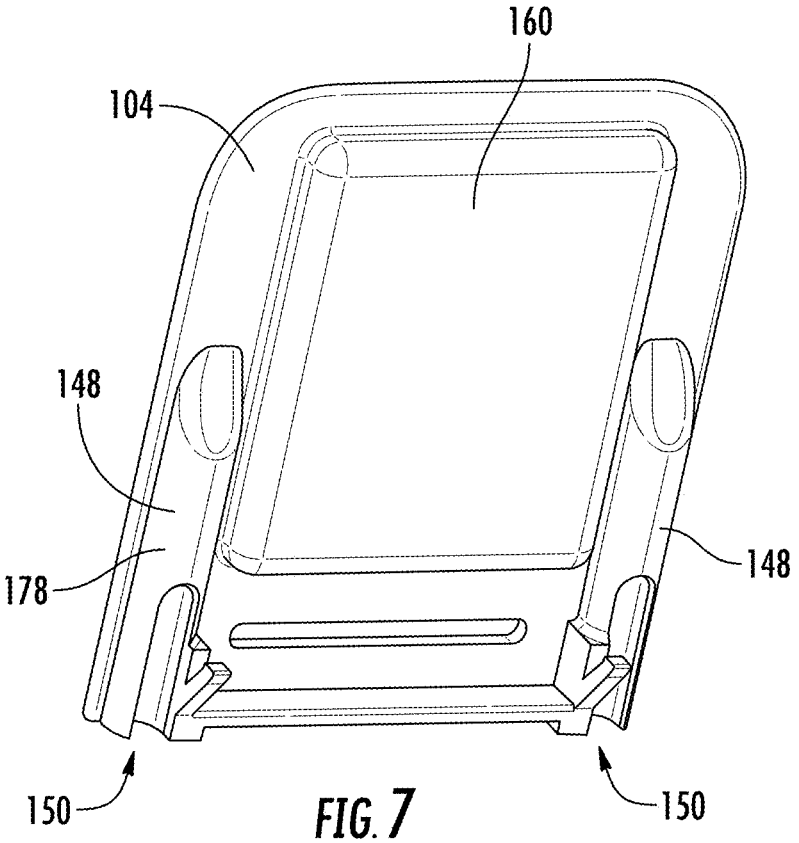
FIG. 7 is a rear perspective illustration of the front stop of the tray of FIG. 1.

With principle reference to FIG. 4, wire support structure 110 includes a plurality of lateral members 154 and a plurality of longitudinal members 156 extending generally perpendicular to lateral member 154. As its name implies, wire support structure 110 is formed of metal wire, with longitudinal members 156 welded to lateral member 154. Fewer or greater longitudinal members 156 and lateral members 154 may be employed depending on the overall width and length of tray 100.

In this example, the tops of the longitudinal members 156 provides the product support surface 157 (see FIG. 4).

With reference now to FIG. 4, the same illustrates a cross section through the spacers 112 that extend transversely between load bearing members 102. Spacers 112 attach to load bearing members 102 via fasteners such as those shown (see FIG. 1), or any other mechanical expedient. This view illustrates wire supports 134 extending through the spacers 112.

Figure 3:
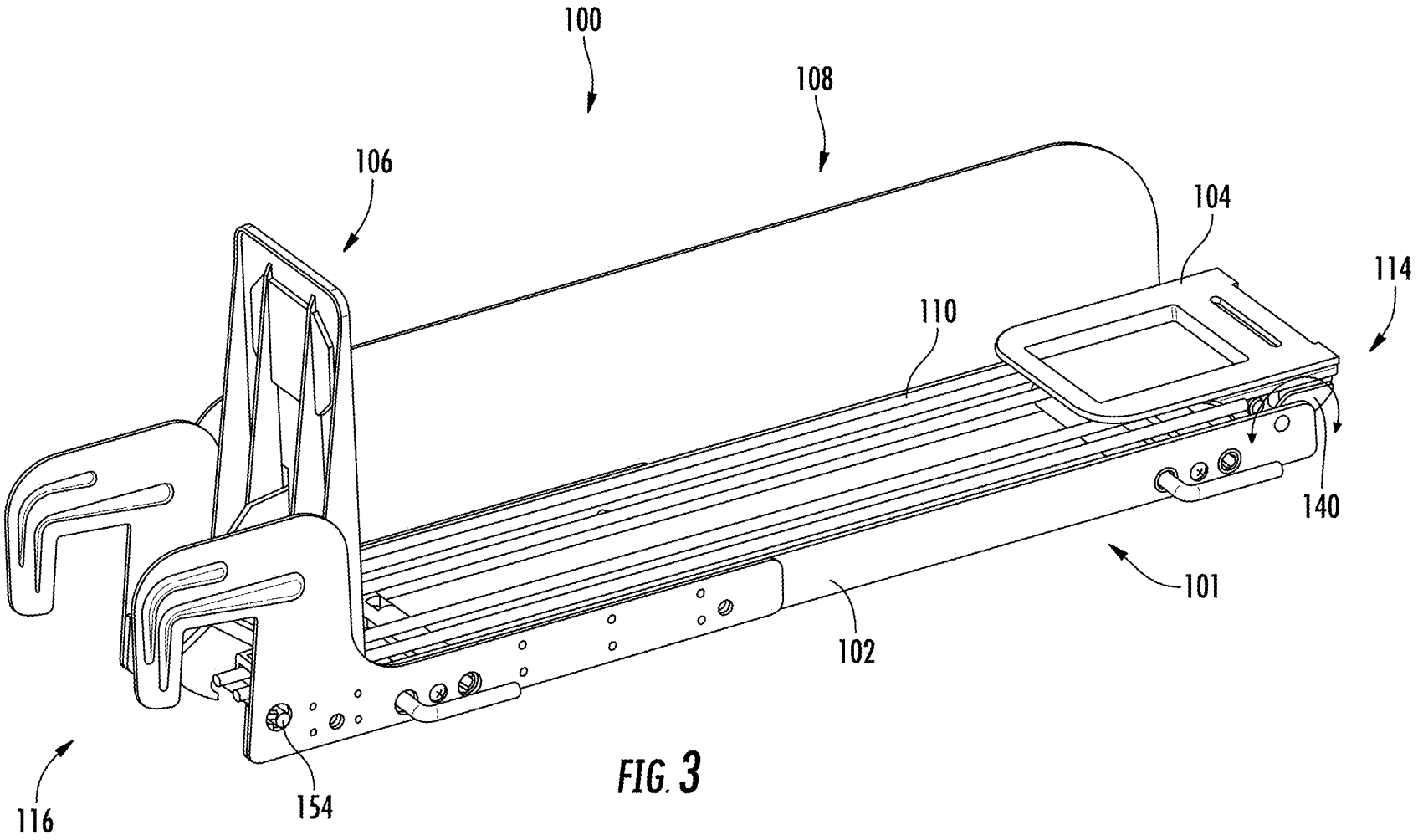
FIG. 3 is a partial illustration of the tray of FIG. 1 with the front stop in a reclined orientation used when filling the tray with merchandise.

In the illustrated example, the front stop 104 is operably mounted to allow for pivoting between an upright orientation shown, for example, in FIG. 1 and a reclined orientation shown, for example, in FIG. 3. In the upright orientation, the front stop 104 inhibits removal of merchandise from the tray 100. In the reclined orientation, merchandise may be more easily loaded into the tray 100 from the first end 114 of tray 100.

However, embodiments need not have this pivoting ability such that the front stop 104 always remains in the upright orientation.

Figure 2:
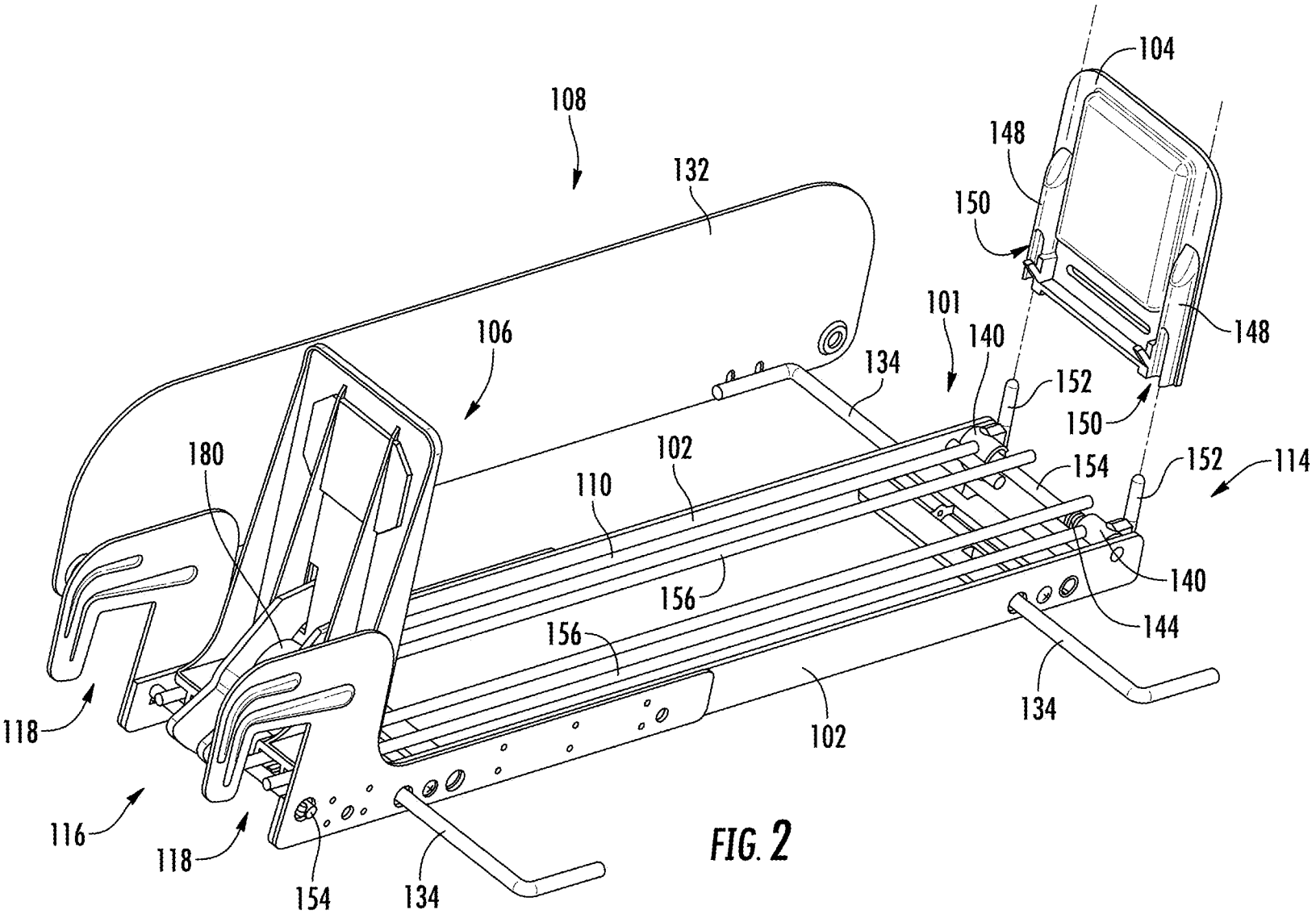
FIG. 2 is a partially exploded illustration of the retail merchandise tray of FIG. 1 with one of the divider walls removed.

The front stop 104 is mounted to the product support structure 101 and particularly to the wire support structure 110 by a pair of front stop hinges 140 (see e.g FIGS. 2 and 4). The front stop hinges 140 are substantially mirror images of one another in the illustrated embodiment. However, there are some minor differences to accommodate a torsion spring for biasing the front stop 104 toward the upright orientation. In some embodiments, the two fronts top hinges 140 are mirror images and both are configured for receipt of a torsion spring even though a single spring may be incorporated.

The front stop hinges 140 are mounted to the front most lateral member 154 for rotation about lateral member 154 and particularly about a rotational axis defined thereby. The front stop hinges 140 rotate between a first angular position that maintains the front stop 104 in the upright orientation and a second angular position that maintains the front stop 104 in the reclined orientation. As such, the front stop 104 rotates about lateral member 154 between the upright and reclined orientations.

The main body of the front stop hinge 140 includes a mounting cavity that receives a free end of lateral member 154. In the illustrated embodiment, the mounting cavity is in the form of a bore that extends entirely through the main body. In other embodiments, the mounting cavity could be a recess.

In the current embodiment, the adjacent load bearing member 102 secures the front stop hinge 140 on lateral member 154. In the particular embodiment, the free end of lateral member 154 extends into a correspondence cavity of the bearing member 102. As such, the load bearing member 102 is positioned laterally to the side of the front stop hinge 140 such that it cannot be removed from lateral member 154. This locks the front stop hinge 140 to the product support structure 101 and particularly, in this embodiment, the wire support structure 110 and more particularly lateral member 154.

In some embodiments, in the reclined orientation, the front surface of a front panel section 143 of the front stop 104 is substantially parallel to the product support surface 157 defined by wire support structure 110 (e.g. plus or minus 20 degrees). In the upright orientation, the front surface of the front panel section 143 is substantially orthogonal to the product support surface (e.g. plus or minus 20 degrees). At a minimum, when the front stop 104 is rotated rearwards, the top edge 145 of the front stop 104 is closer to the wire support structure 110 than when front stop 104 is in the upright orientation.

A biasing member 144 illustrated in the form of a torsion spring that extends angularly about lateral member 154 biases the front stop hinge 140 toward the first angular position, e.g. toward the upright orientation. In this orientation, the front stop 104 prevents product from being pushed off of the product support surface 157 by pusher 106.

The front stop 104 is preferably releasably mounted to the front stop hinges 140 such that the front stop 104 can be removed from the front stop hinges 140 without the front stop hinges 140 needing to be removed from the product support structure 101 and particularly from the wire support structure 110 and more particularly from lateral member 154. This allows for simple replacement in the event of damage, reconfiguration, different front stops 104, etc. without requiring disassembly of the system.

With reference to FIG. 2, the front stop 104 includes a pair of mounting pin receivers 148 that provide mounting pin slots 150 that receive a corresponding axially extending mounting pin 152 of the corresponding front stop hinge 140. Preferably, a friction fit is provided between the mounting slots 150 and mounting pins 152. In some embodiments, one or both of the mounting pins 152 or mounting slots 150 have a taper such that increased insertion of the pin 152 into the mounting slot 150 increases frictional engagement between the components.

To avoid or reduce the denting problem with prior art front stops, the front stop 104 includes a product support section 160 that provides a second product support surface 162. The product support surface 162 provides increased contact area for supporting a front of self-faced merchandise. For products that could be dented, the increased contact area provided by the product support surface 162 reduces localized pressure to inhibit the denting caused by the biasing force of the pusher 106.

Figure 8:
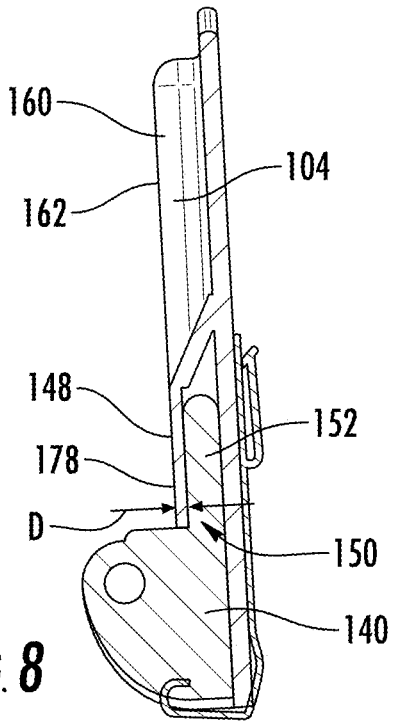
FIG. 8 is a partial cross-sectional illustration of the front stop mounted to the front stop hinges.
Figure 9:
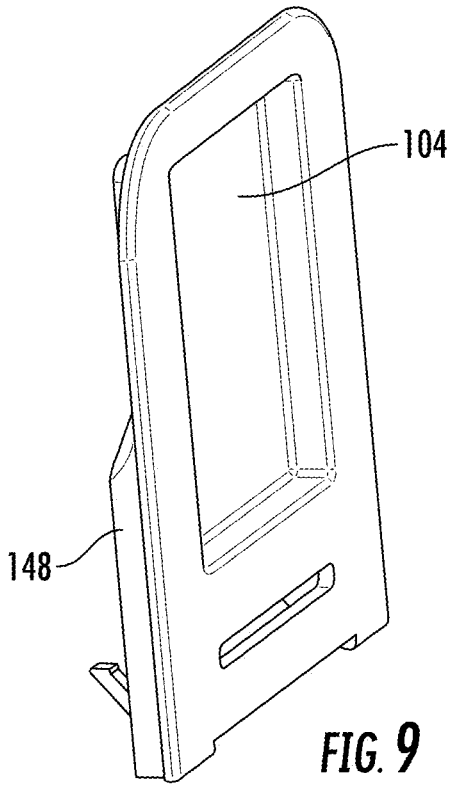
FIG. 9 is a front perspective illustration of the front stop of the tray of FIG. 1.
Figure 12:
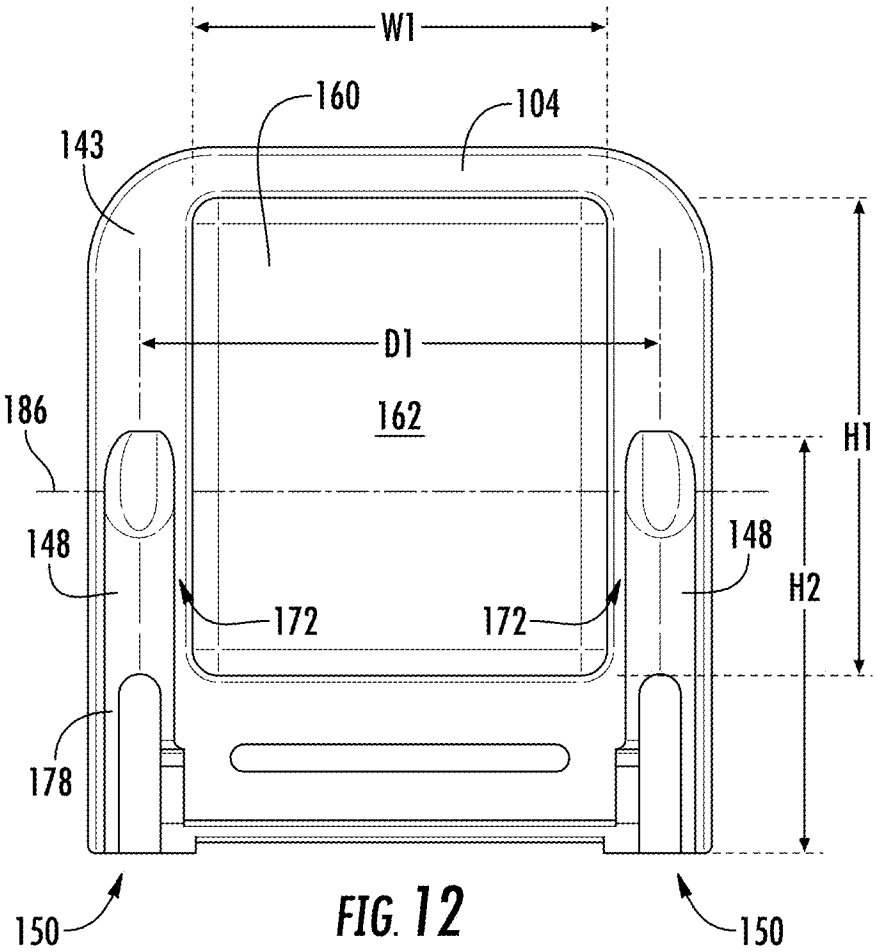
FIG. 12 is a rear view of the front stop the tray of FIG. 1.
Figure 11:
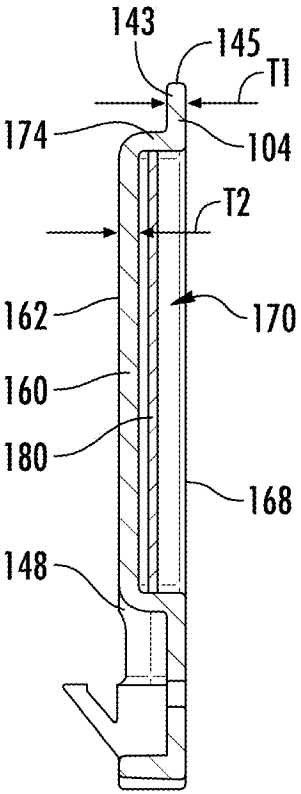
FIG. 11 is a cross-sectional view of the front stop of the tray of FIG. 1.
Figure 10:
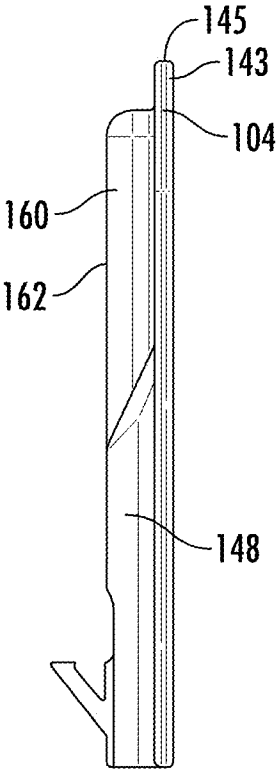
FIG. 10 is a side view of the front stop of the tray of FIG. 1.

The mounting pin receivers 148 project rearward from the front panel section 143 no further than the product support surface 162. As illustrated in FIGS. 8, 10 and 11, the rear most surface of the mounting pin receivers 148 is coplanar with the product support surface 162. In some implementations, the mounting pin receivers 148 may be offset from the product support surface 162, preferably, towards the rear side of the front panel section 143 such that the product support surface 162 is located axially along axis 164 (FIG. 1) closer to the rear end 116 of the tray 100. In other words, the product support surface 162 is further from the front 168 of the front stop 104 than the rear most extent of the mounting pin receivers 148.

With reference to FIG. 11, in one embodiment, the product support section 160 forms as a recess 170 in the front panel section 143. The recess 170 is surrounded by the front panel section 143. This arrangement offsets the product support surface 162 rearward of a rear side of the front panel section 143 that faces the pusher 106/rear end 116 of the tray 100. The front stop 104 includes an offset wall 174 that offsets the product support surface 162 rearward from the front panel section 143 and that generally defines the depth of recess 170 and that surrounds recess 170.

Preferably, the thickness T1 of the front panel section 143 is substantially equal to the thickness T2 of the product support section 160. As such, thicknesses T1 and T2 are within 15% of one another and preferably within 10% of one another.

Product support surface 162 is illustrated as a planar surface however other shapes and configurations are contemplated that increase the contact area that cooperates with self-faced merchandise.

The product support section 160 and product support surface 162 are located laterally between the spaced apart mounting pin receivers 148. In this embodiment, channels 172 are formed between the mounting pin receivers 148 and the product support section. In one embodiment, the width W1 of the product support surface is at 50% the distance D1 that the mounting pin receivers 148 are spaced apart (measured between the centerlines thereof) and more preferably at least 75%. The width W1 and distance D1 are generally measured along a second axis 186 that is perpendicular to axis 164. Further, preferably, the surface area provided by the product support surface 162 is at least, for non-limiting example, three, five or ten (or intervals therebetween) times greater than the surface area of the mounting pin receivers 148.

In one example, the outer periphery of the front panel section 143 bounds a first surface area and the outer periphery of the product support section 160 bounds a second surface area. Preferably, the second surface area is at least 50% of the first surface area and even more preferably at least 75% of the first surface area.

In an example, the width W2 of the channels 172, at a bottom thereof, is less than ¼ inch and more preferably less than ⅛ inch.

In one example, the height H1 of the product support section 160 is taller than the height H2 of the mounting pin receivers 148. Preferably, at least 25% greater. Preferably, the top of the product support section 160 is positioned closer to the top 145 than the top of the mounting pin receivers 148.

Each mounting pin receivers 148 in the illustrated example is formed from an arcuate sidewall 178 that extends around and forms the corresponding mounting slot 150. In a preferred implementation, the thickness T3 varies from the thicknesses T1 and T3 by no more than 25%.

With reference to FIG. 11, signage 180 can be located within recess 170. This signage could be adhesively secured to front stop 104 or be mechanically secured therein, such as by tabs engaging slots in the sidewall 174 or be sized slightly larger than the inner periphery defined by sidewall 174 so as to be secured therein.

Figure 13:
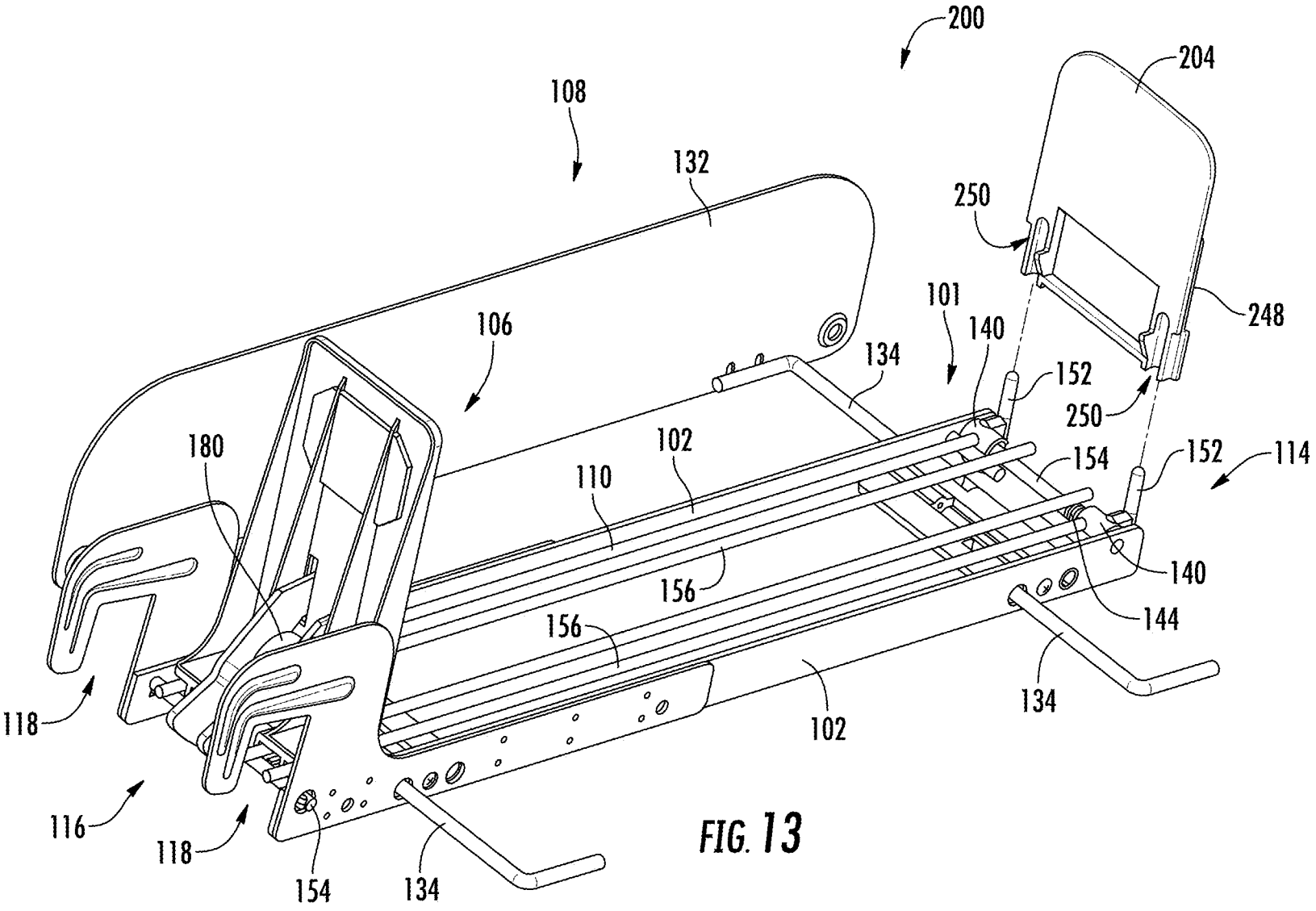
FIG. 13 is an alternative embodiment of a retail merchandise tray.
Figure 14:
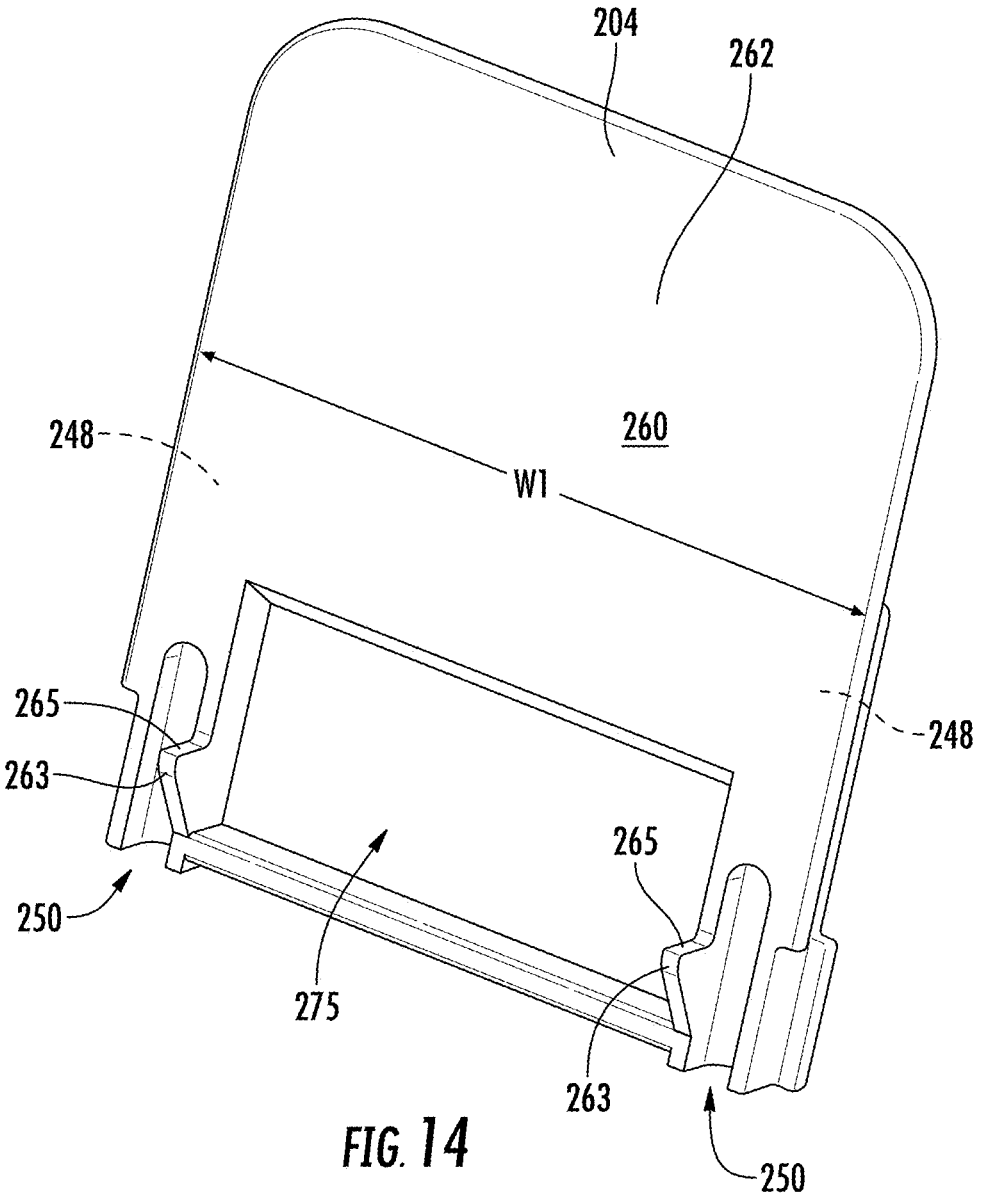
FIG. 14 is rear perspective illustration of a front stop of the tray of FIG. 13.

FIG. 13 illustrates a further example of a tray 200. The tray 100 is substantially the same as tray 100. In this tray, the front stop 204. In this embodiment, the front stop 204 has been changed.

The front stop 204 includes a pair of mounting pin receivers 248 that provide mounting pin slots 250 that, like slots 150, receive a corresponding axially extending mounting pin 152 of the corresponding front stop hinge 140. Preferably, a friction fit is provided between the mounting slots 250 and mounting pins 252. In some embodiments, one or both of the mounting pins 252 or mounting slots 250 have a taper such that increased insertion of the pin 252 into the mounting slot 250 increases frictional engagement between the components. Like front stop 104, front stop 204 is removeable from front stop hinges 140 for replacement purposes.

To avoid or reduce the denting problem with prior art front stops, the front stop 204 includes a product support section 260 that provides a product support surface 262. The product support surface 262 provides increased contact area for supporting a front of self-faced merchandise. For products that could be dented, the increased contact area provided by the product support surface 262 reduces localized pressure to inhibit the denting caused by the biasing force of the pusher 106.

In this example, product support surface 262 is the rear most portion of the front stop 204 except for mounting projections 263. However, mounting projections 263, in operation, are below the product support surface defined by the product support structure 101 when front stop 204 is upright and has product biased thereagainst. This is because the mounting projections 263 include an abutment 265 that engages the lateral member 154 of the wire support structure 110 to secure the front stop 204 on the mounting pins 152. When the front stop 204 is an upright orientation, abutment and the rest of mounting projection 263 is vertically below lateral member 154. Thus, because the projections 263 are below the product support surface of the product support structure 101, these projections 263 will not interact with any product supported by the product support structure 101. Thus, mounting projections 263 do not form part of the product support surface 262 of the front stop 204.

Figure 15:
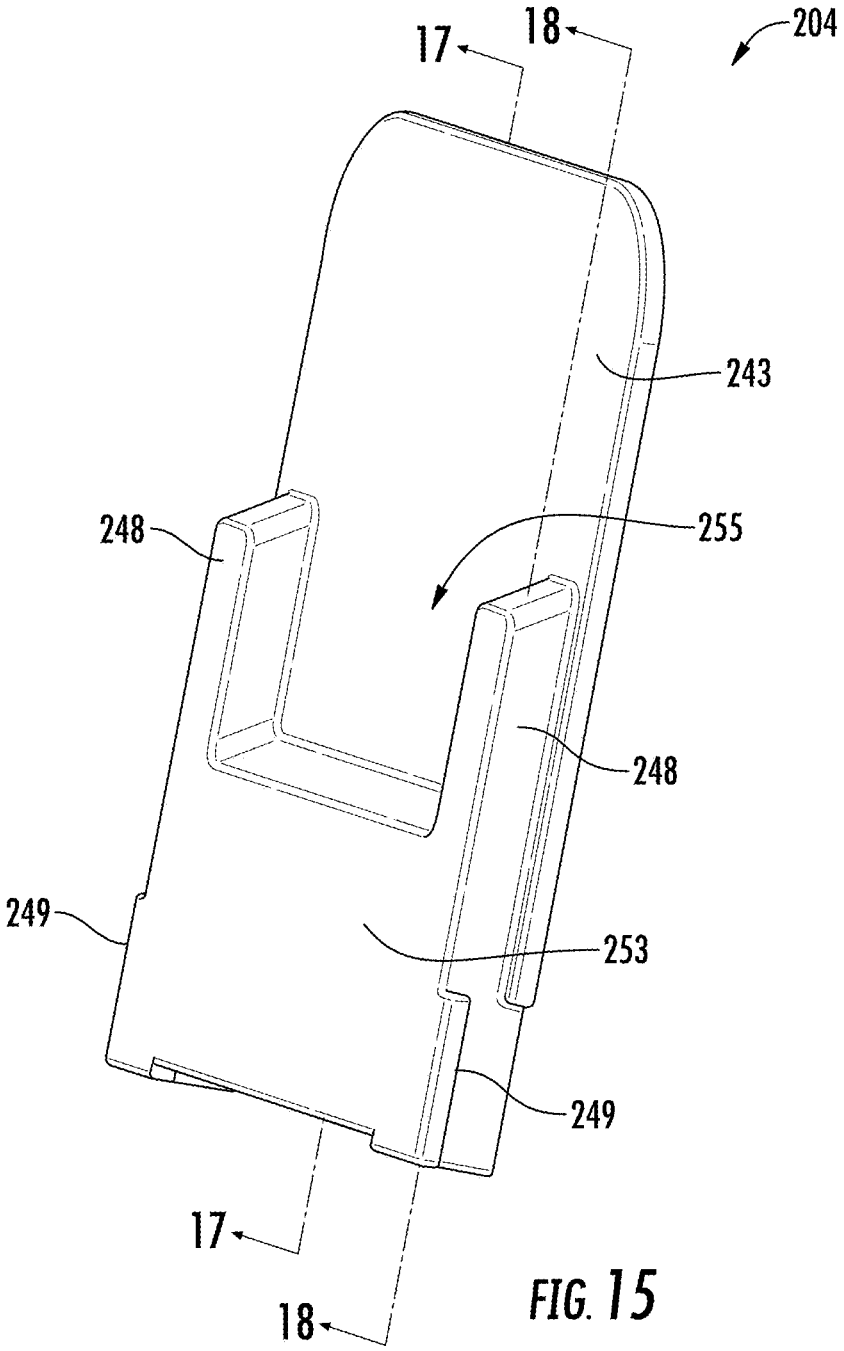
FIG. 15 is a front perspective illustration of the front strop of FIG. 14.
Figure 16:
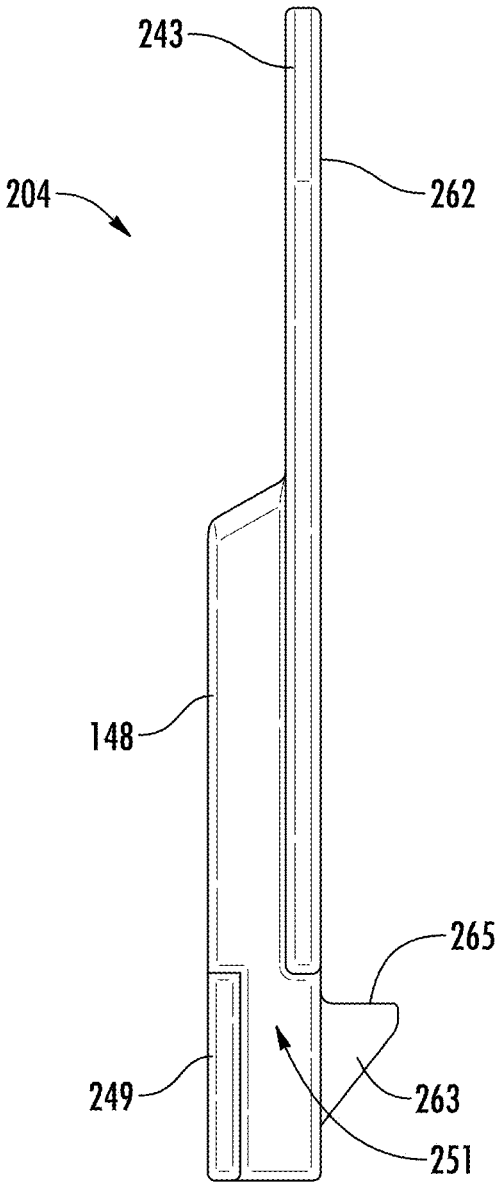
FIG. 16 is a side view of the front stop of FIG. 14.
Figure 17:
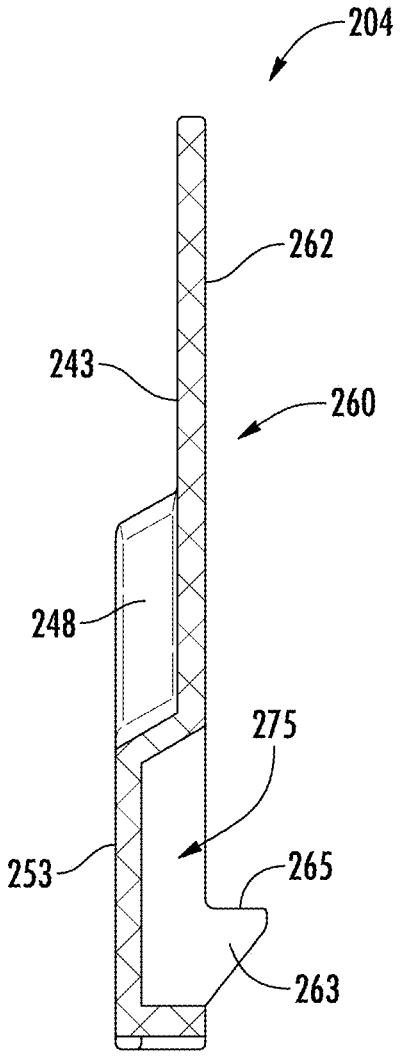
FIG. 17 is a cross-section of the front stop of FIG. 14 take about line 17-17.
Figure 18:
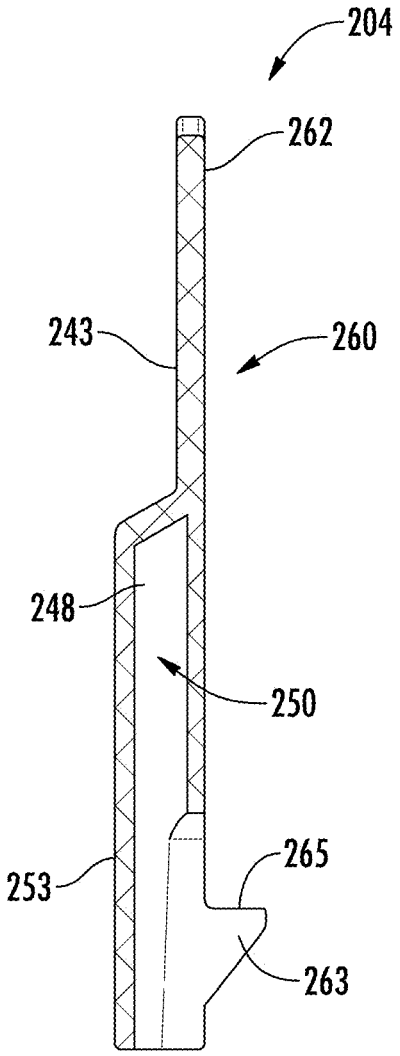
FIG. 18 is a cross-section of the front stop of FIG. 14 taken about line 18-18.

With reference to FIGS. 15 and 16, the mounting pin receivers 248 project forward of panel section 243 that generally defines product support surface 262. This is opposite of front stop 104.

As illustrated in FIG. 15, in this example, the panel section 243 extends laterally outward beyond the mounting pin receivers 248. Lateral projections 249 extend laterally outward from the mounting pin receivers 248. Lateral projections 249 are spaced forward of panel section 243 such that slots 251 are formed between the lateral projections 249 and the portion of the panel section 243 that extends laterally outward beyond the mounting pin receivers 248.

Front stop 204 includes front panel region 253 that is generally planar and that provides a forward most portion of the front stop 204. In this example, the mounting pin receivers 248 extend upward further than the front panel region 253 forming a recessed region 255 above the front panel region 253 and between the laterally spaced apart mounting pin receivers 248.

In this embodiment, a recess 275 is formed between the spaced apart projections 263 and below product support region 260. In the illustrated embodiment, the entire width W1 of the product support section 260 above recess 275 is planar.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A front stop for a retail merchandise tray having first and second mounting pins, the front stop comprising:

a panel section having a front side and a rear side;

first and second mounting pin receivers being spaced apart from one another along a first axis, the first mounting pin receiver receiving the first mounting pin therein and the second mounting pin receiver receiving the second mounting pin therein when mounted;

a product support section positioned between the first and second mounting pin receivers, the product support section defining a product support surface, the first and second mounting pin receivers positioned relative to the rear side of the panel section no further than the product support surface, wherein the first and second mounting pin receivers and the product support section are formed as a single continuous piece.

2. The front stop of claim 1, wherein the product support surface is rearward of the rear side of the panel section.

3. The front stop of claim 1, further including a recess in a front of the front stop, the panel section extends around the recess.

4. The front stop of claim 3, wherein a thickness of the panel section is equal to a thickness of the product support section.

5. The front stop of claim 3, wherein the front stop includes an offset wall that extends between the panel section and the product support section, the offset wall bounds the recess.

6. The front stop of claim 1, wherein a surface area of the second product support surface is at least three, five or 10 (3, 5 or 10) times greater than a surface area of the first and second mounting pin receivers.

7. The front stop of claim 1, further comprising:

a first channel formed between the product support section and the first mounting pin receiver; and a second channel formed between the product support section and the second mounting pin receiver.

8. The front stop of claim 7, wherein each of the first and second channels has a width measured along the first axis of less than ¼ inch.

9. The front stop of claim 7, wherein each of the first and second channels has a width measured along the first axis of less than ⅛ inch.

10. The front stop of claim 1, wherein the second product support surface extends entirely between the first and second mounting pin receivers.

11. The front stop of claim 1, wherein the panel section defines an outer periphery that bounds a first area and the product support section has an outer periphery rearward of the panel section that bounds a second area, the second area being at least 50% the first area.

* * * * *